US012791281B1

(12) United States Patent
Lin

(10) Patent No.: US 12,791,281 B1
(45) Date of Patent: Nov. 10, 2026

(54) AIR GUN WITH FLOW-GUIDE DEVICE STRUCTURE

(71) Applicant: Yu-Wei Lin, New Taipei City (TW)

(72) Inventor: Yu-Wei Lin, New Taipei City (TW)

( * ) Notice: Subject to any disclaimer, the term of this patent is extended or adjusted under 35 U.S.C. 154(b) by 0 days.

(21) Appl. No.: 19/390,472

(22) Filed: Nov. 14, 2025

(30) Foreign Application Priority Data

Sep. 17, 2025 (TW) ..... 114135743

(51) Int. Cl.
*F41B 11/73* (2013.01)
*F41B 11/68* (2013.01)

(52) U.S. Cl.
CPC ..... *F41B 11/68* (2013.01); *F41B 11/73* (2013.01)

(58) Field of Classification Search
CPC ..... F41B 11/62; F41B 11/60; F41B 11/73; F41B 11/72
See application file for complete search history.

(56) References Cited

U.S. PATENT DOCUMENTS

2006/0060178 A1* 3/2006 Lai ..... F41B 11/721 124/74
2012/0160226 A1* 6/2012 Cho ..... F41B 11/723 124/73
2025/0067536 A1* 2/2025 Chong ..... F41B 11/724

* cited by examiner

*Primary Examiner* — J. Woodrow Eldred
(74) *Attorney, Agent, or Firm* — Bradley J. Thorson; DeWitt LLP

(57) ABSTRACT

In an air gun with a flow-guide device structure, pulling a trigger advances a pusher to move a first one of multiple pellets in a pellet guiding channel into a barrel while the trigger pushes a release member so that the release member is separated from a sleeve member, a high-pressure gas is released through a gap between a flow-guide member and the sleeve member to shoot the multiple pellets out of the barrel, and an elastic member is resisted by a limiting cylinder and then pushes back the sleeve member to close the gap, completing a shooting operation of the air gun.

8 Claims, 11 Drawing Sheets

AIR GUN WITH FLOW-GUIDE DEVICE STRUCTURE

BACKGROUND OF THE INVENTION

Field of the Invention

The invention relates to an air gun, and more particularly to an air gun with a flow-guide device structure, in which a gun body can shoot a pellet with the provision of a flow-guide module.

Description of Related Art

Survival games have become one kind of the popular leisure activities in recent years. Various competitive events are regularly held publicly, or many parents bring their children to form teams and compete against each other.

On weekends and holidays, there are also themed camping events that allow people to connect with nature and enhance family interaction and the like. In the survival games, there are a variety of toy guns including electric guns, gas guns, pneumatic guns, air guns and the like. Also, the toy bullets include paintballs, water pellets, foam pellets, commonly used BB pellets and the like. Various toy guns have their users and enthusiasts.

Moreover, toy guns typically refer to those with relatively low kinetic energy and non-lethal power, so they are widely used in other occasions, such as animal deterrent guns, riot control guns and the like. Regarding "riot control guns," their sound effects can rival those of equivalent gunpowder weapons. However, this often leads to a misconception about their lethal power; and in reality, they are not particularly useful.

This is primarily due to the use of larger caliber toy bullets, and the bullets are directly pushed by the $CO_2$ pressure. Riot control guns have consistently faced a common problem that they tend to consume their power source quickly with the power weakening or even $CO_2$ depletion after only a few shots. Furthermore, small steel cylinders are usually used to store the $CO_2$, making replacement difficult and inconvenient due to structural limitations. Therefore, there is an urgent need for a structure design that can effectively guide the gas flow without leakage, air loss, or excessive gas waste.

Consequently, how to improve the aforementioned drawbacks is the technical challenge that the inventor of this application seeks to resolve.

SUMMARY OF THE INVENTION

To achieve the above-identified objective, the invention relates to an air gun with a flow-guide device structure. The air gun includes a gun body, a flow-guide module, a barrel and multiple pellets. The gun body extends from a front-end lower position to a middle position to form a pellet guiding channel. The pellet guiding channel initially translates linearly and then gradually extends upwardly. One side of a distal end of the pellet guiding channel is formed with a barrel recess, and the other side of the distal end of the pellet guiding channel is formed with a limiting recess. A pusher is pivotally mounted on one side of the pellet guiding channel. A push-stop portion is formed at one edge position of the pusher. A push-shift portion is formed at a top position of the pusher. The other edge position of the pusher retracts inwardly to form a fitting portion.

A guiding portion extends downwardly along one side of the fitting portion. A trigger is pivotally mounted at a middle lower position of the gun body. The trigger upwardly extends to form a push-movement portion. The push-movement portion is disposed in the fitting portion.

The trigger has a trigger recess at a middle position, a trigger push piece is pivotally mounted on the trigger recess, and a release member is pivotally mounted above the trigger. A contact portion is formed at a bottom position of the release member. The trigger push piece can contact the contact portion. An engaging portion is formed at a top position of the release member. The flow-guide module includes a flow-guide member, a sleeve member, an elastic member, a limiting cylinder and an air chamber. The flow-guide module is disposed at a rear-end position of the gun body. The flow-guide member has an air storage portion at a middle inner side, and one end of the flow-guide member outwardly extends to form an exhaust cylinder portion. The exhaust cylinder portion has an air way on a middle inner side.

The air way can be connected to the air storage portion. The exhaust cylinder portion has at least three flow-guide holes connected to the air way. The exhaust cylinder portion outwardly extends to form an air blocking portion. One edge of the air blocking portion is formed with a venting portion.

The venting portion gradually narrows from the edge of the air blocking portion. The sleeve member has a containing portion at a middle inner side.

One end of the containing portion has an inlet portion, and a first O-ring is disposed at the inlet portion. An opposite end of the containing portion has an outlet portion. A second O-ring is disposed at the outlet portion. The sleeve member fits with the exhaust cylinder portion through the inlet portion and obstructs each of the flow-guide holes. Also, the venting portion projects beyond the outlet portion, and one end of the sleeve member is formed with a limiting groove. One end of the limiting groove is formed with a pressing portion.

The elastic member passes through the sleeve member. A middle inner side of the limiting cylinder is formed with a blocking portion. The limiting cylinder fits with one end of the elastic member. The limiting cylinder is disposed on the limiting recess. The other end of the elastic member presses against the pressing portion, and the one end of the elastic member presses against the blocking portion so that the elastic member is compressed between the limiting cylinder and the sleeve member.

The engaging portion is secured within the limiting groove to restrict movement of the sleeve member. The other end of the flow-guide member is connected with the air chamber.

The air chamber can be interconnected with the air storage portion. A high-pressure gas is contained within the air chamber. A pellet loading portion is disposed on one end of the barrel. The barrel is disposed on the barrel recess, and the multiple pellets are disposed in the pellet guiding channel. Thus, pulling the trigger pushes the pusher forward to move forwards so that the first pellet of the multiple pellets is moved from the pellet guiding channel to the pellet loading portion while the trigger contacts the release member so that the release member is detached from the sleeve member. The high-pressure gas is released from the venting portion to shoot out the first pellet from the barrel, thereby completing the shooting operation of the air gun.

DETAILED DESCRIPTION OF THE INVENTION

Figure 1:
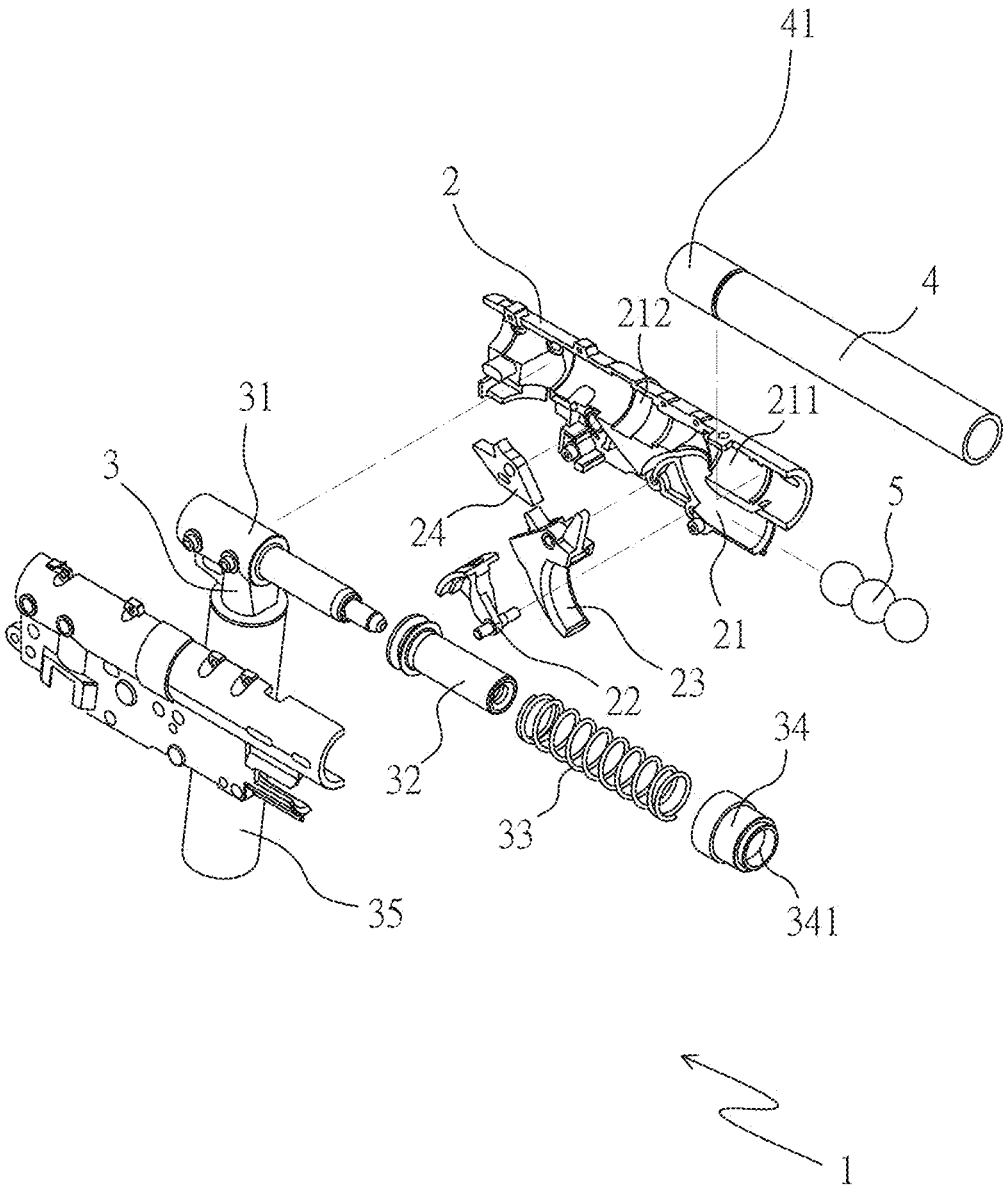
FIG. 1 is a pictorially exploded view of the invention.
Figure 2:
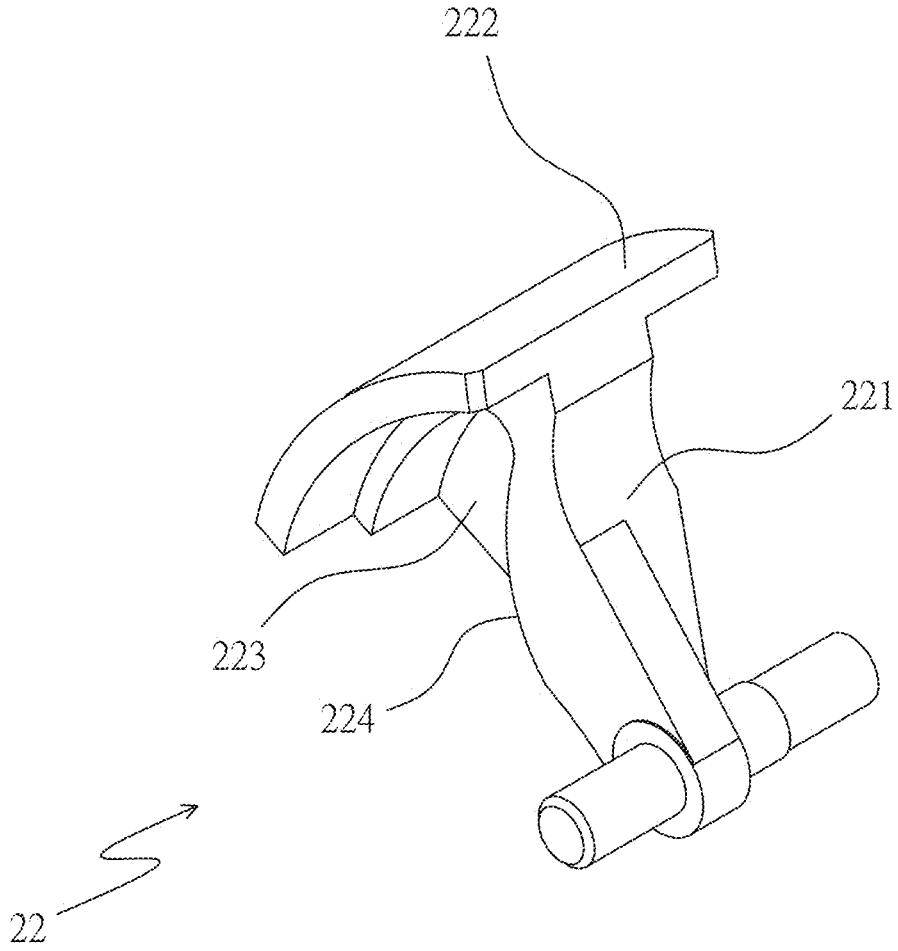
FIG. 2 is a first partial schematic view of the invention.
Figure 3:
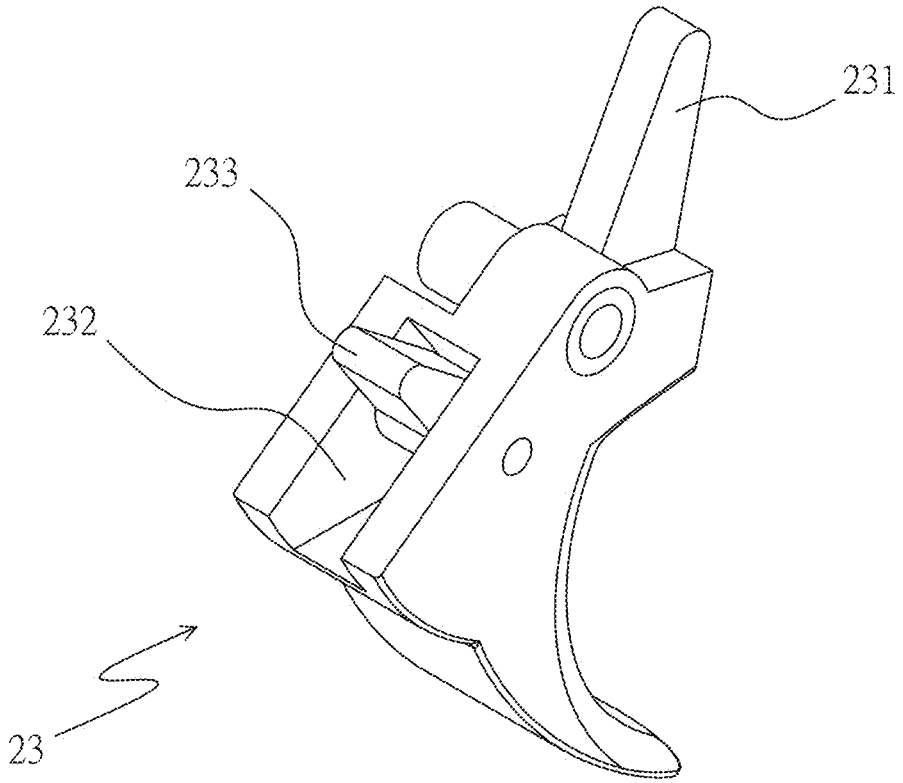
FIG. 3 is a second partial schematic view of the invention.
Figure 4:
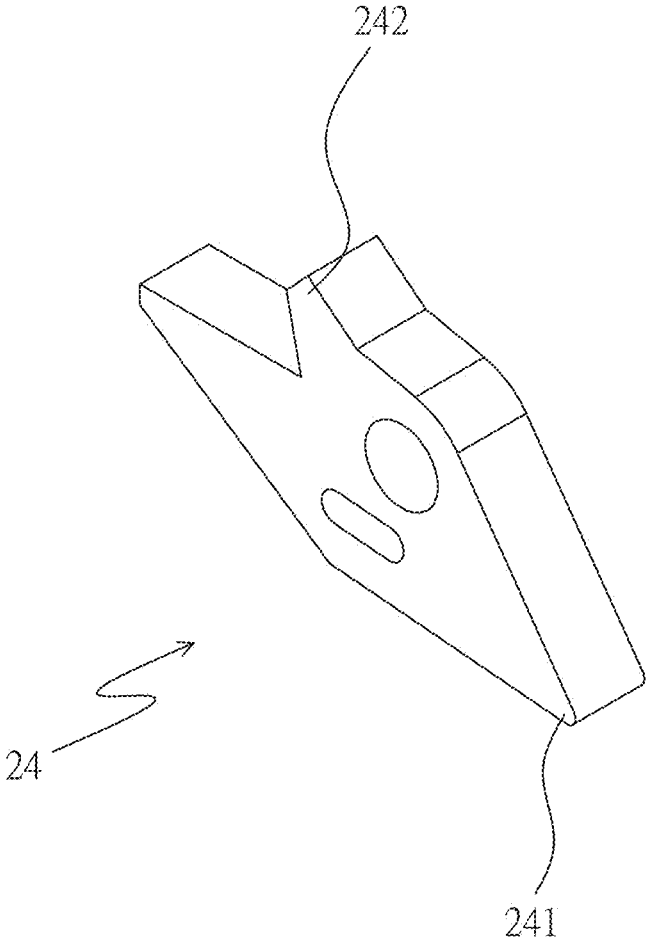
FIG. 4 is a third partial schematic view of the invention.
Figure 5:
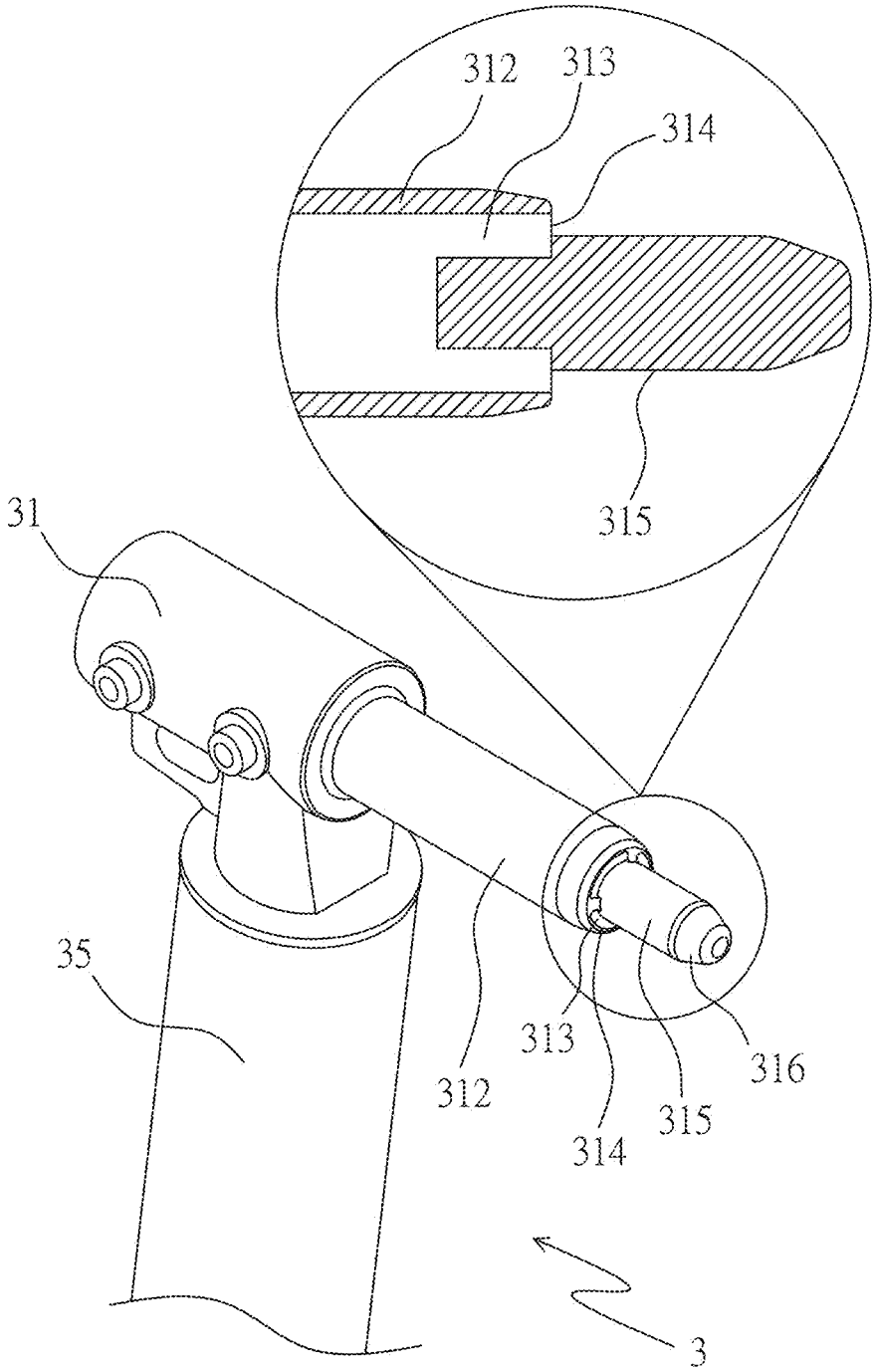
FIG. 5 is a fourth partial schematic view of the invention.
Figure 6:
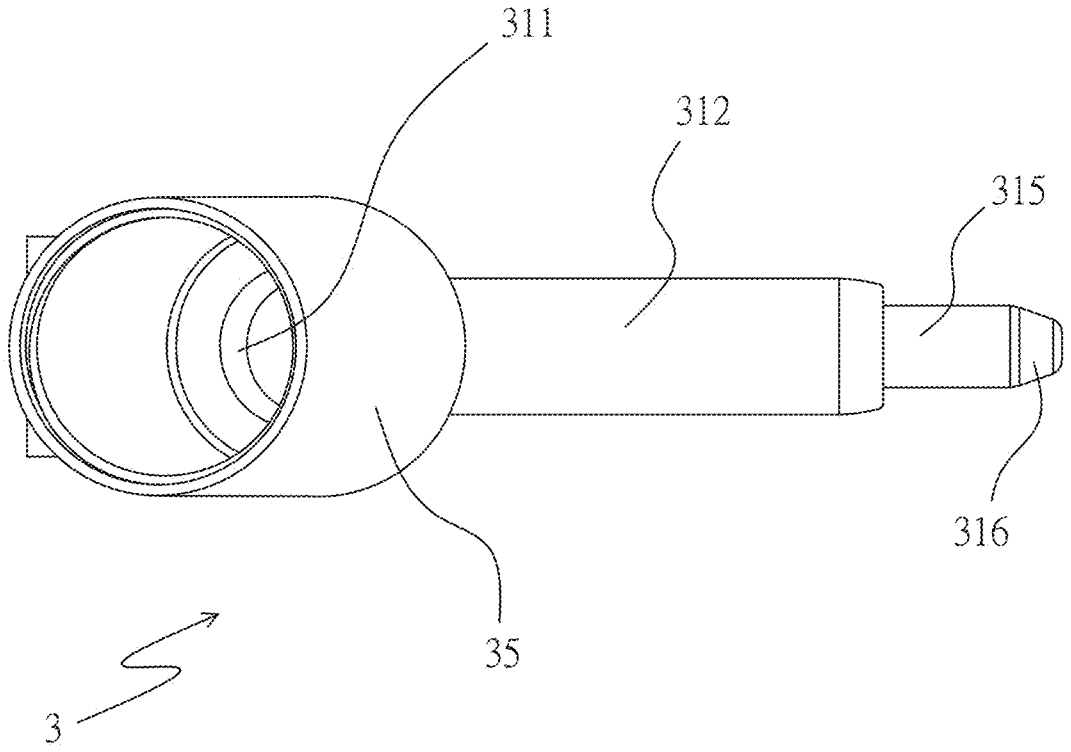
FIG. 6 is a fifth partial schematic view of the invention.
Figure 7:
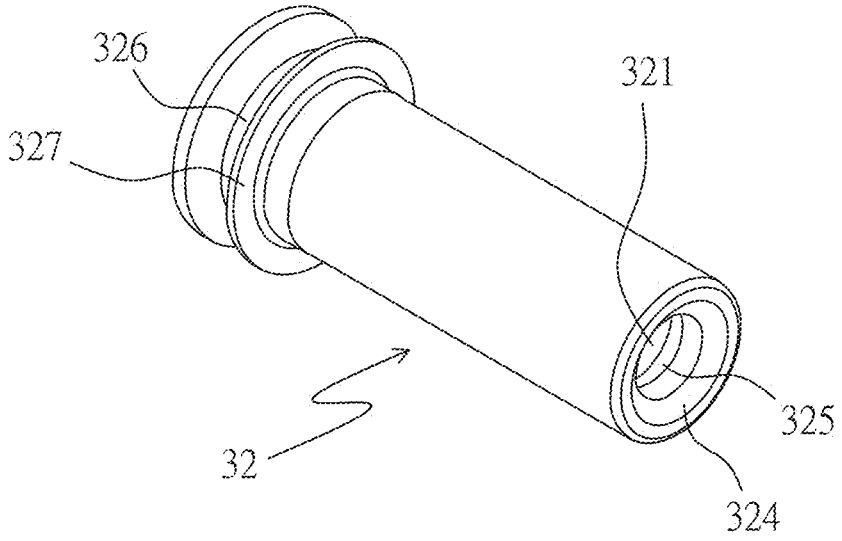
FIG. 7 is a sixth partial schematic view of the invention.
Figure 7:
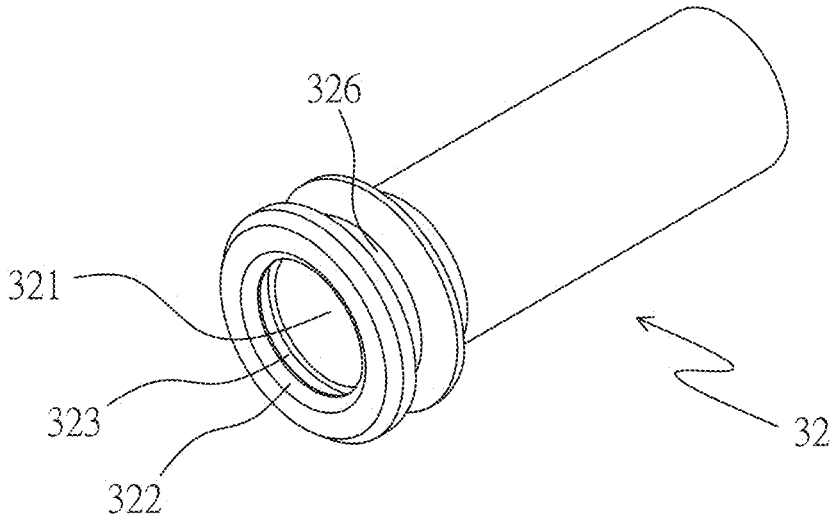
Figure 8:
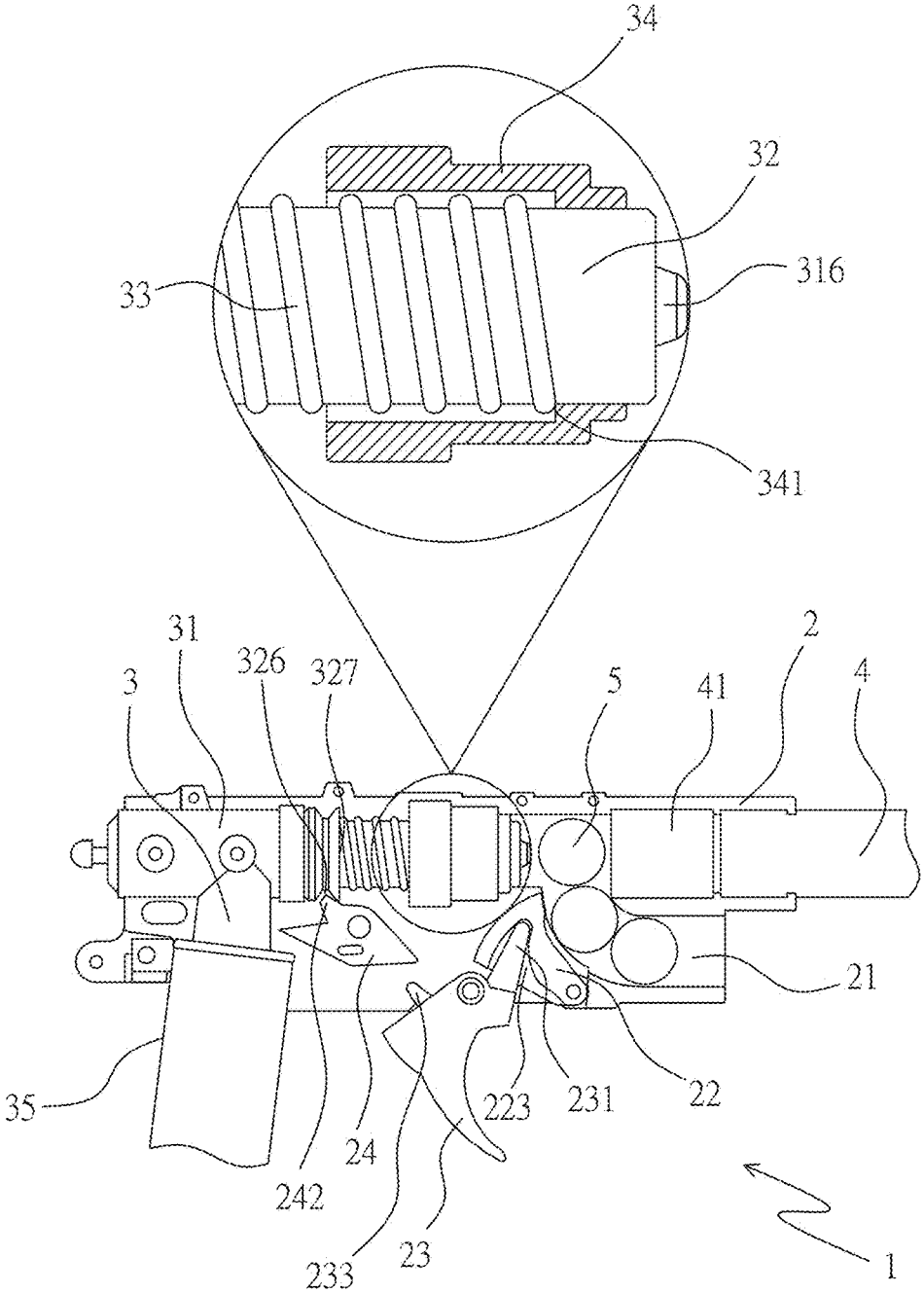
FIG. 8 is a seventh partial schematic view of the invention.
Figure 9:
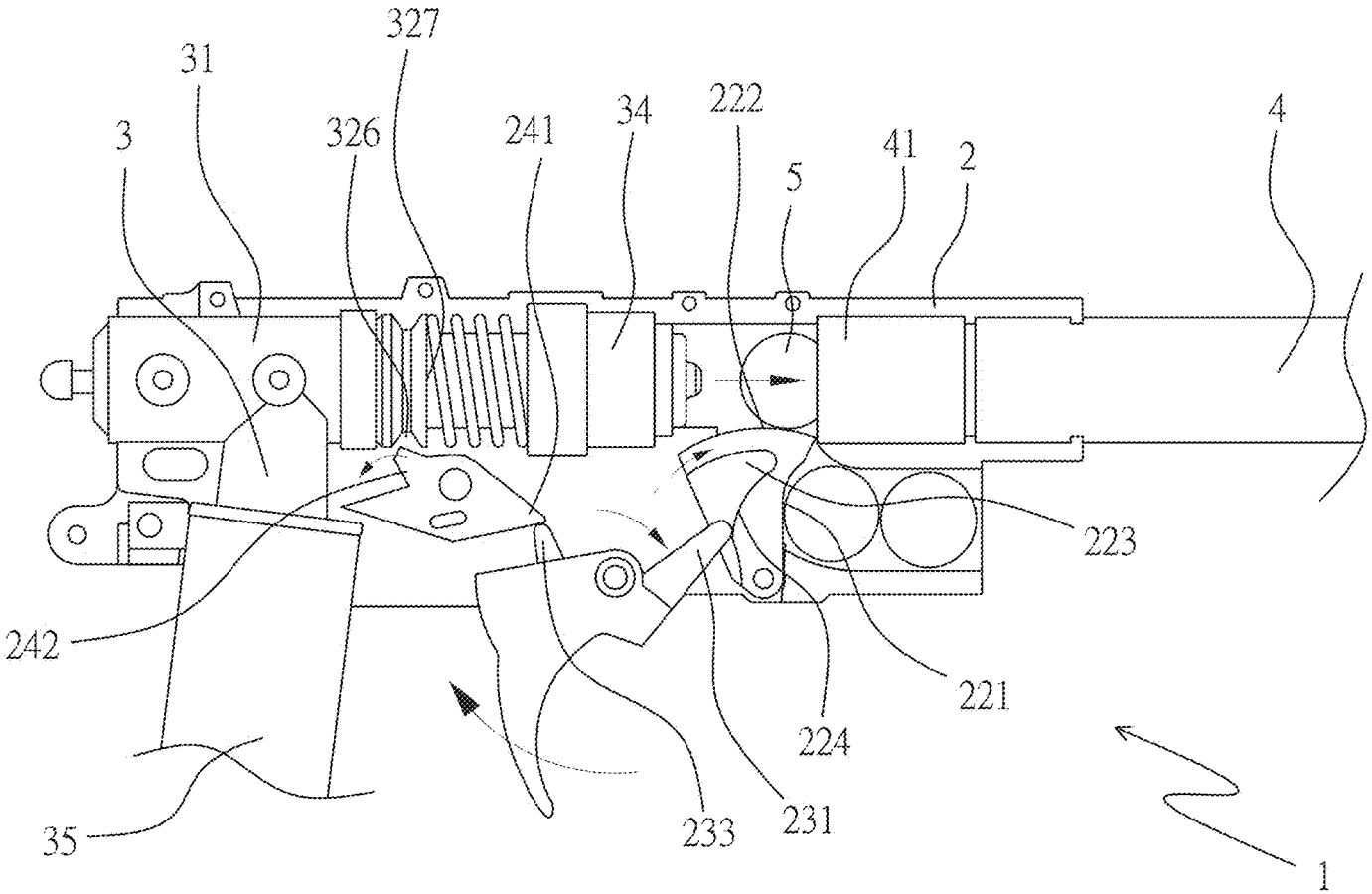
FIG. 9 is a first schematic view of a preferred embodiment of the invention.
Figure 10:
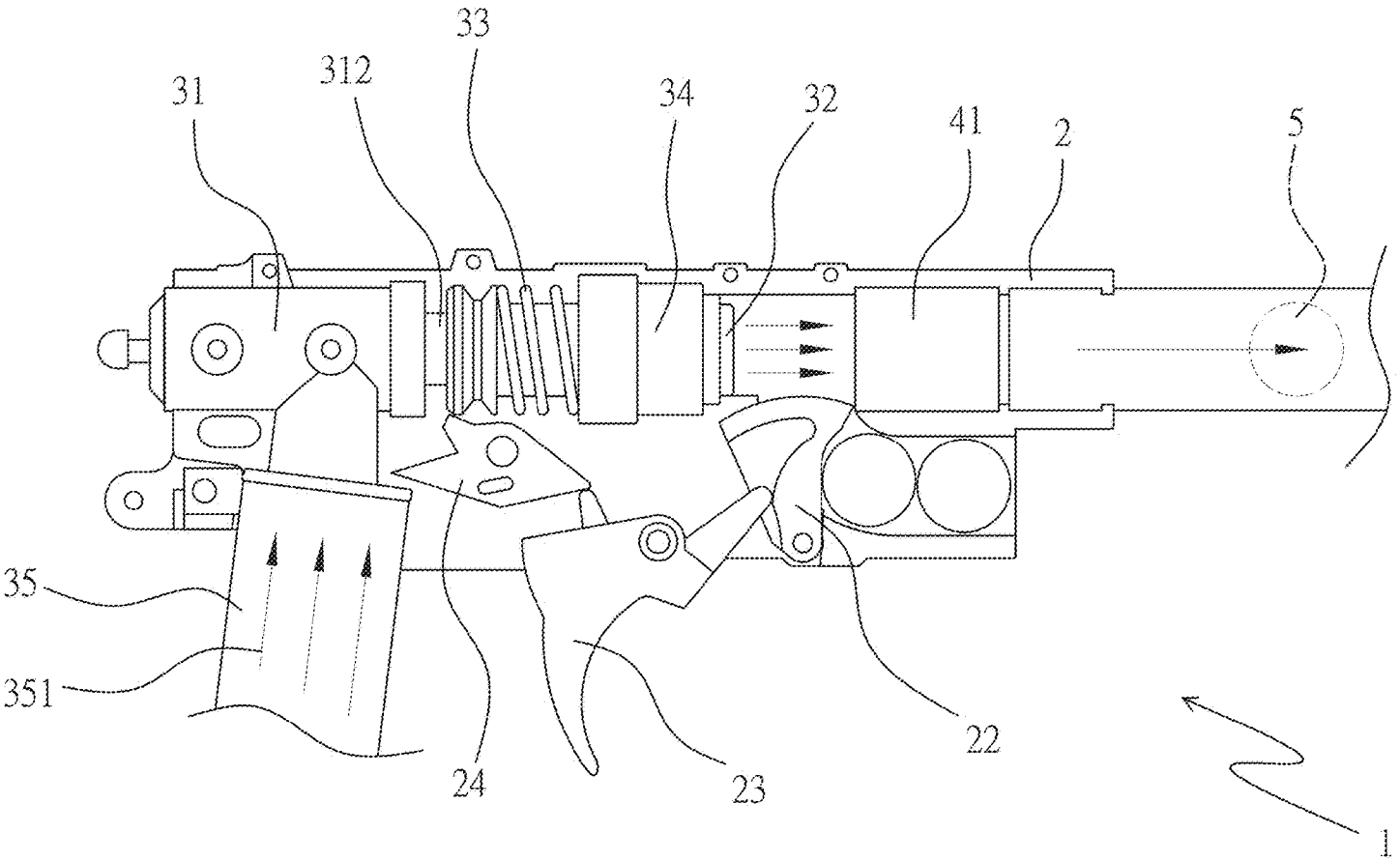
FIG. 10 is a second schematic view of the preferred embodiment of the invention.
Figure 11:
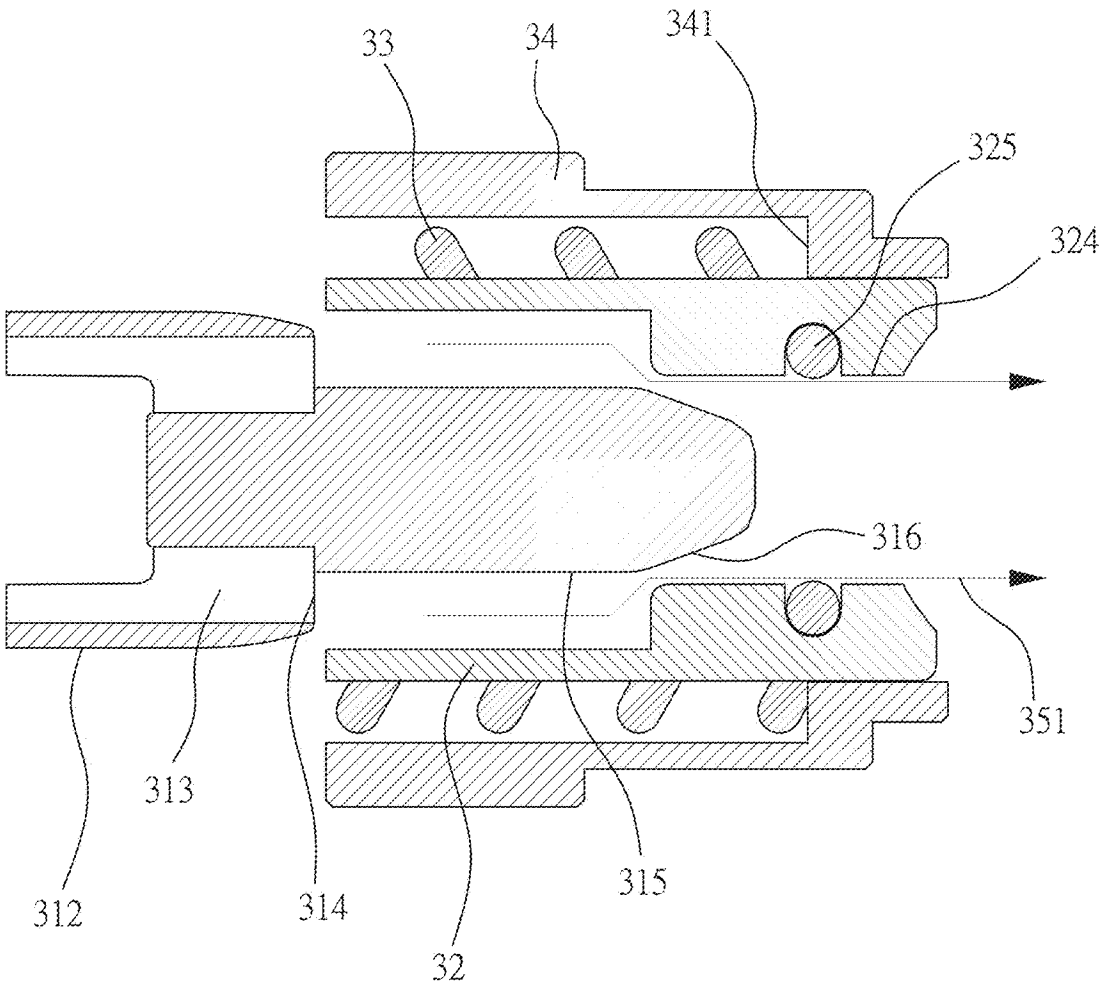
FIG. 11 is a schematic view of a further preferred embodiment of the invention.

Referring to FIGS. 1 to 11, which are a pictorially exploded view, first to seventh partial schematic views, first and second schematic views of a preferred embodiment, and a schematic view of a further preferred embodiment of the invention, it can be clearly seen from the figures that an air gun 1 includes a gun body 2, a flow-guide module 3, a barrel 4 and multiple pellets 5.

The gun body 2 extends from a front-end lower position to a middle position to form a pellet guiding channel 21. One side of a distal end of the pellet guiding channel 21 is formed with a barrel recess 211, and the other side of the distal end of the pellet guiding channel 21 is formed with a limiting recess 212.

A pusher 22 is pivotally mounted on one side of the pellet guiding channel 21. A push-stop portion 221 is formed at one edge position of the pusher 22. A push-shift portion 222 is formed at a top position of the 1*o* pusher 22.

The other edge position of the pusher 22 retracts inwardly to form a fitting portion 223. A guiding portion 224 extends downwardly along one side of the fitting portion 223.

A trigger 23 is pivotally mounted at a middle lower position of the gun body 2. The trigger 23 upwardly extends to form a push-movement portion 231. The trigger 23 has a trigger recess 232 at a middle position. A trigger push piece 233 is pivotally mounted on the trigger recess 232. A release member 24 is pivotally mounted above the trigger 23.

A contact portion 241 is formed at a bottom position of the release member 24. The trigger push piece 233 can contact the contact portion 241, and an engaging portion 242 is formed at a top position of the release member 24. The flow-guide module 3 includes a flow-guide member 31, a sleeve member 32, an elastic member 33, a limiting cylinder 34 and an air chamber 35.

The flow-guide module 3 is disposed at a rear-end position of the gun body 2. The flow-guide member 31 has an air storage portion 311 on a middle inner side. One end of the flow-guide member 31 outwardly extends to form an exhaust cylinder portion 312. The exhaust cylinder portion 312 has an air way 313 on a middle inner side. The air way 313 can be connected to the air storage portion 311.

The exhaust cylinder portion 312 has at least three flow-guide holes 314 each connected to the air way 313.

The exhaust cylinder portion 312 outwardly extends to form an air blocking portion 315. One edge of the air blocking portion 315 is formed with a venting portion 316. The sleeve member 32 has a containing portion 321 at a middle inner side.

One end of the containing portion 321 has an inlet portion 322, and a first O-ring 323 is disposed at the inlet portion 322. An opposite end of the containing portion 321 has an outlet portion 324, and a second O-ring 325 is disposed at the outlet portion 324.

One end of the sleeve member 32 is formed with a limiting groove 326. One end of the limiting groove 326 is formed with a pressing portion 327. The elastic member 33 passes through the sleeve member 32.

A middle inner side of the limiting cylinder 34 is formed with a blocking portion 341. The limiting cylinder 34 fits with one end of the elastic member 33.

The limiting cylinder 34 is disposed on the limiting recess 212. The other end of the elastic member 33 presses against the pressing portion 327, and the one end of the elastic member 33 presses against the blocking portion 341 so that the elastic member 33 is compressed between the limiting cylinder 34 and the sleeve member 32. The engaging portion 242 is secured within the limiting groove 326 to restrict movement of the sleeve member 32.

The other end of the flow-guide member 31 is connected with the air chamber 35, and the air chamber 35 can be interconnected with the air storage portion 311. The barrel 4 is disposed at the barrel recess 211 and has one end provided with a pellet loading portion 41. The pellets 5 are disposed in the pellet guiding channel 21. The pellet guiding channel 21 initially translates linearly and then gradually extends upwardly. The push-stop portion 221 is an inwardly curved arc surface, and the push-shift portion 222 is an outwardly curved arc surface. The push-movement portion 231 is disposed in the fitting portion 223, and the push-movement portion 231 can move downwards along the guiding portion 224.

The venting portion 316 gradually narrows from the edge of the air blocking portion 315. The sleeve member 32 fits with the exhaust cylinder portion 312 through the inlet portion 322 and obstructs each of the flow-guide holes 314 between the first O-ring 323 and the second O-ring 325, and the venting portion 316 projects beyond the outlet portion 324.

A high-pressure gas 351 is contained within the air chamber 35. Because the air way 313 is connected to the air storage portion 311 and the air chamber 35 is connected to the air storage portion 311, the high-pressure gas 351 can flow from the air chamber 35 through the air storage portion 311 to the exhaust cylinder portion 312. The exhaust cylinder portion 312, the air blocking portion 315, the venting portion 316, the outlet portion 324, the limiting cylinder 34 and the pellet loading portion 41 are disposed on a common axis. The main features are described in the following. The gun body 2 extends from the front-end lower position to the middle position to form the pellet guiding channel 21. The pellet guiding channel 21 initially translates linearly and then gradually extends upwardly.

The one side of the distal end of the pellet guiding channel 21 is formed with the barrel recess 211, and the other side thereof is formed with the limiting recess 212. The one side of the pellet guiding channel 21 is pivotally mounted on the pusher 22. The one edge position of the pusher 22 is formed with the push-stop portion 221. The push-stop portion 221 is an inwardly curved arc surface.

The top position of the pusher 22 is formed with the push-shift portion 222. The push-shift portion 222 is the outwardly curved arc surface.

The other edge position of the pusher 22 retracts inwardly to form with the fitting portion 223. The guiding portion 224 extends downwardly along the one side of the fitting portion 223. The trigger 23 is pivotally mounted at the middle lower position of the gun body 2. The trigger 23 upwardly extends to form the push-movement portion 231. The push-movement portion 231 is disposed in the fitting portion 223. The push-movement portion 231 can move downwards along the guiding portion 224, and the trigger 23 has the trigger recess 232 at the middle position.

The trigger push piece 233 is pivotally mounted on the trigger recess 232. The release member 24 is pivotally mounted above the trigger 23.

The contact portion 241 is formed at the bottom position of the release member 24. The trigger push piece 233 can contact the contact portion 241, and the engaging portion 242 is formed at the top position of the release member 24. The flow-guide module 3 includes the flow-guide member 31, the sleeve member 32, the elastic member 33, the limiting cylinder 34 and the air chamber 35. The flow-guide module 3 is disposed at the rear-end position of the gun body 2. The flow-guide member 31 has the air storage portion 311 at the middle inner side. The one end of the flow-guide member 31 outwardly extends to form the exhaust cylinder portion 312. The exhaust cylinder portion 312 has the air way 313 at the middle inner side. The air way 313 can be connected to the air storage portion 311. The exhaust cylinder portion 312 has at least three flow-guide holes 314.

Each of the flow-guide holes 314 is connected to the air way 313. The exhaust cylinder portion 312 outwardly extends to form the air blocking portion 315. One edge of the air blocking portion 315 is formed with the venting portion 316. The venting portion 316 gradually narrows from the edge of the air blocking portion 315. The sleeve member 32 has the containing portion 321 at the middle inner side.

The one end of the containing portion 321 has the inlet portion 322, and the first O-ring 323 is disposed at the inlet portion 322.

The opposite end of the containing portion 321 has the outlet portion 324, and the second O-ring 325 is disposed at the outlet portion 324. The sleeve member 32 fits with the exhaust cylinder portion 312 through the inlet portion 322 and obstructs each of the flow-guide holes 314 between the first O-ring 323 and the second O-ring 325. The venting portion 316 projects beyond the outlet portion 324. The one end of the sleeve member 32 is formed with the limiting groove 326. The one end of the limiting groove 326 is formed with the pressing portion 327.

The elastic member 33 passes through the sleeve member 32. The middle inner side of the limiting cylinder 34 is formed with the blocking portion 341. The limiting cylinder 34 fits with the one end of the elastic member 33. The limiting cylinder 34 is disposed on the limiting recess 212. The other end of the elastic member 33 presses against the pressing portion 327, and the one end of the elastic member 33 presses against the blocking portion 341 so that the elastic member 33 is compressed between the limiting cylinder 34 and the sleeve member 32.

The engaging portion 242 is secured within the limiting groove 326 to restrict the movement of the sleeve member 32. The other end of the flow-guide member 31 is connected with the air chamber 35. The high-pressure gas 351 is contained within the air chamber 35. The air chamber 35 can be interconnected with the air storage portion 311.

Because the air way 313 is connected to the air storage portion 311 and the air chamber 35 is connected to the air storage portion 311, the high-pressure gas 351 can flow from the air chamber 35 through the air storage portion 311 to the exhaust cylinder portion 312. The barrel 4 is disposed at the barrel recess 211. The pellet loading portion 41 is provided at the one end of the barrel 4. The exhaust cylinder portion 312, the air blocking portion 315, the venting portion 316, the outlet portion 324, the limiting cylinder 34 and the pellet loading portion 41 are disposed on a common axis. The multiple pellets 5 are disposed in the pellet guiding channel 21. Thus, the user pulls the trigger 23 so that the push-movement portion 231 moves downwards from the fitting portion 223 along the guiding portion 224, and pushes the pusher 22 to move forward.

With the inwardly curved arc surface of the push-stop portion 221, the push-stop portion 221 separates the first pellet and the second pellet of the multiple pellets 5 from each other, and limits the other pellet(s) of the multiple pellets 5 after the second pellet in the pellet guiding channel 21.

Then, with the outwardly curved arc surface of the push-shift portion 222, the push-shift portion 222 moves the first pellet of the multiple pellets 5 into the pellet loading portion 41, and the pusher 22 can separate the barrel 4 from the pellet guiding channel 21, creating a separation. At the same time, the trigger push piece 233 touches and pushes the contact portion 241 upwards, thereby releasing the engaging portion 242 from the limiting groove 326, and freeing the limitation of the sleeve member 32.

Because the high-pressure gas 351 is contained within the air chamber 35, the air chamber 35 is connected to the air storage portion 311, the air way 313 is connected to the air storage portion 311, and each of the flow-guide holes 314 is connected to the air way 313, the high-pressure gas 351 can flow through the air storage portion 311 and reach the exhaust cylinder portion 312.

In addition, the high-pressure gas 351 is sealed by the first O-ring 323 in the exhaust cylinder portion 312 and sealed by the second O-ring 325 in the air blocking portion 315, and is thus restricted within the air storage portion 311 and the air way 313. When the pressure of the high-pressure gas 351 is higher than that of the elastic member 33 and when the sleeve member 32 is no longer restricted by the engaging portion 242, the sleeve member 32 moves forward. At this time, the second O-ring 325 moves to the venting portion 316, thereby no longer sealing the air blocking portion 315, and forming a gap between the outlet portion 324 and the venting portion 316.

The high-pressure gas 351 bursts out through each of the flow-guide holes 314 and is instantaneously and completely released between the outlet portion 324 and the venting portion 316 through the gradually narrowing venting portion 316, thereby shooting the first pellet of the multiple pellets 5 from the pellet loading portion 41 through the barrel 4. The pusher 22 separating the barrel 4 from the pellet guiding channel 21 can effectively guide the high-pressure gas 351 toward the barrel 4 to increase the kinetic energy of propelling the pellet 5.

The high-pressure gas 351 is released through the outlet portion 324 and the venting portion 316. A portion of the high-pressure gas 351 flows forward to generate the kinetic energy to shoot the pellets 5 through the barrel 4. The other portion of the high-pressure gas 351 remains within the flow-guide module 3. When the limiting cylinder 34 disposed on the limiting recess 212 is completely restricted, the other end of the elastic member 33 presses against the pressing portion 327, and the one end of the elastic member 33 presses against the blocking portion 341, the elastic member 33 is compressed by the sleeve member 32 and rapidly extends its elasticity. With the assistance of another portion of the high-pressure gas 351 remaining within the flow-guide module 3, the elastic member 33 returns to its settings and immediately pushes the sleeve member 32 back to the original.

At this time, the second O-ring 325 sealing against the air blocking portion 315 to close the gap between the outlet portion 324 and the venting portion 316, and the engaging portion 242 is secured within the limiting groove 326 to restrict the movement of the sleeve member 32 and prepare for the next shot. This also conveniently achieves the shooting fun of the air gun 1.

The air gun 1 of the invention includes the gun body 2, the flow-guide module 3, the barrel 4 and the multiple pellets 5 combined together. The gun body 2 extends from the front-end lower position to the middle position to form the pellet guiding channel 21. The gun body 2 is sequentially pivotally mounted with the pusher 22, the trigger 23 and the release member 24. The flow-guide module 3 is disposed at the rear-end position of the gun body 2. The flow-guide module 3 includes the flow-guide member 31, the sleeve member 32, the elastic member 33, the limiting cylinder 34 and the air chamber 35 combined together. The barrel 4 is disposed at the barrel recess 211, and the pellet loading portion 41 is disposed at the one end of the barrel 4.

The multiple pellets 5 are disposed in the pellet guiding channel 21. When the trigger 23 is pulled, the push-movement portion 231 conveniently pushes the pusher 22 forwards, the push-shift portion 222 moves the first pellet 5 into the pellet loading portion 41, the push-stop portion 221 restricts the second and other pellets 5 within the pellet guiding channel 21, and the trigger push piece 233 moves upwards to contact the contact portion 241, so that the engaging portion 242 is detached from the limiting groove 326 and releases the restriction of the sleeve member 32.

When the pressure of the high-pressure gas 351 is higher than that of the elastic member 33, the second O-ring 325 moves to the venting portion 316, thereby no longer providing an airtight seal against the air blocking portion 315 and opening the gap between the outlet portion 324 and the venting portion 316. Furthermore, the pusher 22 separates the barrel 4 from the pellet guiding channel 21 to guide the high-pressure gas 351 to move toward the barrel 4.

The high-pressure gas 351 then flows out of each of the flow-guide holes 314 and is completely released via the gap between the outlet portion 324 and the venting portion 316, thereby shooting out the first pellet 5 from the pellet loading portion 41 through the barrel 4 to complete the shooting operation of the air gun 1.

The embodiments listed hereinabove are presented to illustrate preferred and feasible embodiments of the invention, and are not intended to limit the scope of the invention. Any person skilled in the art may make slight modifications and refinements without departing from the spirit and scope of the invention. Therefore, the scope of protection of the invention shall be determined by the claims appended hereto.

What is claimed is:

1. An air gun with a flow-guide device structure, the air gun comprising a gun body, a flow-guide module, a barrel and multiple pellets, wherein: the gun body extends from a front-end lower position to a middle position to form a pellet guiding channel, one side of a distal end of the pellet guiding channel is formed with a barrel recess, the other side of the distal end of the pellet guiding channel is formed with a limiting recess, a pusher is pivotally mounted on one side of the pellet guiding channel, a push-stop portion is formed at one edge position of the pusher, a push-shift portion is formed at a top position of the pusher, the other edge position of the pusher retracts inwardly to form a fitting portion, a guiding portion extends downwardly along one side of the fitting portion, a trigger is pivotally mounted at a middle lower position of the gun body, the trigger upwardly extends to form a push-movement portion, the trigger has a trigger recess at a middle position, a trigger push piece is pivotally mounted on the trigger recess, a release member is pivotally mounted above the trigger, a contact portion is formed at a bottom position of the release member, the trigger push piece can contact the contact portion, and an engaging portion is formed at a top position of the release member; the flow-guide module includes a flow-guide member, a sleeve member, an elastic member, a limiting cylinder and an air chamber, and is disposed at a rear-end position of the gun body, wherein the flow-guide member has an air storage portion on a middle inner side, one end of the flow-guide member outwardly extends to form an exhaust cylinder portion, the exhaust cylinder portion has an air way on a middle inner side, the air way can be connected to the air storage portion, the exhaust cylinder portion has at least three flow-guide holes each connected to the air way, the exhaust cylinder portion outwardly extends to form an air blocking portion, one edge of the air blocking portion is formed with a venting portion, the sleeve member has a containing portion at a middle inner side, one end of the containing portion has an inlet portion, a first O-ring is disposed at the inlet portion, an opposite end of the containing portion has an outlet portion, a second O-ring is disposed at the outlet portion, one end of the sleeve member is formed with a limiting groove, one end of the limiting groove is formed with a pressing portion, the elastic member passes through the sleeve member, a middle inner side of the limiting cylinder is formed with a blocking portion, the limiting cylinder fits with one end of the elastic member, the limiting cylinder is disposed on the limiting recess, the other end of the elastic member presses against the pressing portion and the one end of the elastic member presses against the blocking portion so that the elastic member is compressed between the limiting cylinder and the sleeve member, the engaging portion is secured within the limiting groove to restrict movement of the sleeve member, the other end of the flow-guide member is connected with the air chamber, and the air chamber can be interconnected with the air storage portion; a barrel, which is disposed on the barrel recess, and has one end provided with a pellet loading portion; and the multiple pellets are disposed in the pellet guiding channel.

2. The air gun according to claim 1, wherein the pellet guiding channel initially translates linearly and then gradually extends upwardly.

3. The air gun according to claim 1, wherein the push-stop portion is an inwardly curved arc surface, and the push-shift portion is an outwardly curved arc surface.

4. The air gun according to claim 1, wherein the push-movement portion is disposed in the fitting portion, and the push-movement portion can move downwards along the guiding portion.

5. The air gun according to claim 1, wherein the venting portion gradually narrows from the edge of the air blocking portion.

6. The air gun according to claim 1, wherein the sleeve member fits with the exhaust cylinder portion through the inlet portion and obstructs each of the flow-guide holes between the first O-ring and the second O-ring, and the venting portion projects beyond the outlet portion.

7. The air gun according to claim 1, wherein a high-pressure gas is contained within the air chamber, wherein because the air way is connected to the air storage portion, and the air chamber is connected to the air storage portion, the high-pressure gas can flow from the air chamber through the air storage portion to the exhaust cylinder portion.

8. The air gun according to claim 1, wherein the exhaust cylinder portion, the air blocking portion, the venting portion, the outlet portion, the limiting cylinder and the pellet loading portion are disposed on a common axis.

* * * * *